US005760691A

United States Patent [19]

Egli

[11] Patent Number: 5,760,691

[45] Date of Patent: Jun. 2, 1998

[54] DIVING MEASURING DEVICE IN PARTICULAR A DIVING COMPUTER

[75] Inventor: Wendelin Egli, Reutlingen, Switzerland

[73] Assignee: Scubapro Eu, Henggart, Switzerland

[21] Appl. No.: 634,262

[22] Filed: Apr. 18, 1996

[30] Foreign Application Priority Data

Apr. 21, 1995 [CH] Switzerland ..... 1152/95

[51] Int. Cl.[6] ..... G08B 23/00

[52] U.S. Cl. ..... 340/573; 340/693; 340/691; 340/665; 340/636; 362/802

[58] Field of Search ..... 340/573, 566, 340/669, 670, 671, 673, 665, 686, 687, 691; 73/431, 291, 300; 368/69; 362/802; 968/213, DIG. 1

[56] References Cited

U.S. PATENT DOCUMENTS

| | | | |
|---|---|---|---|
| 3,681,587 | 8/1972 | Brien | 362/26 |
| 3,729,923 | 5/1973 | Brigliano et al. | 368/69 |
| 3,783,604 | 1/1974 | Florent et al. | 368/69 |
| 3,828,611 | 8/1974 | Shamlian et al. | 73/300 |
| 3,855,784 | 12/1974 | Foellner | 368/69 |
| 3,910,117 | 10/1975 | Wicklund | 73/291 |
| 4,036,007 | 7/1977 | Shelley | 368/69 |
| 4,292,630 | 9/1981 | Dumont | 340/573 |
| 5,023,593 | 6/1991 | Brox | 340/522 |
| 5,197,489 | 3/1993 | Conlan | 128/782 |

FOREIGN PATENT DOCUMENTS 0 152 823 8/1985 European Pat. Off. .

OTHER PUBLICATIONS

Patent Abstracts of Japan, vol. 7, No. 220 (P–226), Sep. 30, 1983.

Patent Abstracts of Japan, vol. 10, No. 327 (P–513), Nov. 7, 1986.

Patent Abstracts of Japan, vol. 12, No. 290 (P–742), Aug. 9, 1988.

*Primary Examiner*—Jeffery Hofsass
*Assistant Examiner*—Benjamin C. Lee
*Attorney, Agent, or Firm*—Jacobson, Price, Holman & Stern, PLLC

[57] ABSTRACT

A diving computer has a housing in which electronic components, at least one diving data display means and an electricity source are disposed water-tightly. Furthermore there are means, accessible from the outside, for connecting the energy source to the electronic elements. The diving data display means is preferably a liquid crystal display module with an integrated background illumination that can be switched on and off. For switching on and off this said illumination, an acceleration sensor and an electronic circuit are mounted in the diving computer. These last-mentioned parts have the effect that the illumination can be switched on or off by merely knocking on the diving computer or hitting the latter against another object. This is a procedure which can also be done underwater easily and safely, using just one hand, despite relatively thick diving gloves.

18 Claims, 2 Drawing Sheets

DIVING MEASURING DEVICE IN PARTICULAR A DIVING COMPUTER

BACKGROUND OF THE INVENTION

This invention relates to a diving measuring device, in particular a diving computer, with a housing in which electronic elements, at least one diving data display device and an electricity source are disposed water-tightly, and which has means for connecting the energy source to the electronic components, the diving data display device having an associated background illumination which can be switched on and off.

Diving measuring devices or diving computers of the above-mentioned type have been known already for some years and are employed by divers to increase their safety, especially sports divers who use pressurized air diving equipment.

The air we breathe is a mixture of about 21% oxygen, 78% nitrogen and 1% other gases. Nitrogen is to be found in dissolved form in the blood and in the bodily tissue of human beings. The quantity depends upon the pressure which surrounds the human body. On the earth's surface, this is air pressure. If a diver dives to a certain depth, the pressure surrounding his body increases. Consequently the blood and bodily tissue of a diver in the deep can absorb several times the amount of nitrogen as is possible on the surface. When the diver rises to the surface, the nitrogen diffuses out of the tissues back into the blood, as a result of the decreasing surrounding pressure, and is transported by the blood to the lungs where it is expelled. If the surrounding pressure decreases too quickly, the nitrogen dissolved in the blood and the bodily tissue cannot be breathed out fast enough. Owing to this supersaturation, gas bubbles result which can lead to damage in the organism.

A diving computer has the important task of helping to ensure that the above-mentioned damage does not occur. The diving computer taken along during a dive determines the diving profile of the diver dependent upon time, and calculates based thereupon, using known formulas or tables, the nitrogen increase or decrease, respectively, in the human body during the time the diver spends at a greater or lesser depth. In particular the diving computer indicates to the diver how he should rise to the surface and how long he should spend at which diving depths so that the aforementioned formation of gas bubbles in the blood does not occur. More modern diving computers keep a so-called log book, with which the time spent above the surface of the water between two or more dives is taken into account.

The most modern technology is used for these little miracle devices. Calculations are made with microprocessors and display of diving data today takes place preferably using a liquid crystal display (LCD). So that the diving data are very legible also in water, in particular at great depths, liquid crystal display modules having a background illumination are used. This background illumination is designed switchable on and off by the diver. The U.S. company sea-Quest has a diving computer with a illuminable LCD module on the market under the name SUUNTO EON, which must be pushed at a spot marked on the housing of the diving computer to switch the illumination on and off. This is an action which is rather difficult to do, especially underwater. With thick diving gloves it is problematical to activate precisely a closely defined, small press point. Usually both hands are needed to do so. Moreover the design and manufacture of a thick, elastic housing location underneath which a press switch is disposed is technically rather difficult and costly.

It is the object of the present invention to create a diving measuring device, in particular a diving computer, which does not have the aforementioned drawbacks.

SUMMARY OF THE INVENTION

This object is attained in that for switching on and off the illumination an element is provided which reacts to changes in motion.

In this way it is only necessary to knock with one hand or with an object against the diving computer or to knock the diving computer against another object to achieve the switching on and off of the illumination of the diving data display device. If the diving computer is worn, for example, with a fastening band on the wrist or on the arm, it suffices to hit the wrist or the arm against the body. The said element sensitive to changes in motion thereby generates an electrical signal which can be used for switching the illumination on or off, respectively.

Regardless of how the diving computer according to the invention is worn, the switching on and off is easy since no particular spot on the housing has to be pushed, and it can be accomplished in any case with one hand.

Preferably used as an element sensitive to changes in motion is an acceleration sensor. Instead of this, use of a microphone would also be conceivable. The acceleration sensor or the microphone are mounted water-tightly in the housing of the diving computer and are not accessible from outside. The installment is thus simple and unproblematical when compared to a press point which must be able to be actuated from outside, at least indirectly. In particular there are no sealing problems. Thin-walled, elastic areas, so called weak points, do not exist on the housing of the diving computer according to the invention.

Liquid crystal display modules with a background illumination are usually used today to display the diving data. Nevertheless other types of display device with illumination which can be switched on and off are likewise conceivable and are not excluded from the invention.

The acceleration sensor, which is preferably used, transmits an electrical signal depending upon the magnitude of change of motion. This signal is supplied to an electronic circuit and correspondingly evaluated there. An electronic circuit comprises essentially an amplifier, a bi-stable switching circuit and a driver circuit to control the illumination. The evaluating electronics are designed in such a way that in particular small signals, which arise from only a rubbing of the housing of the diving computer or from a slow motion, do not cause a switching on or off of the illumination.

By knocking on the housing or hitting the latter on another object, typical signals in a low frequency range are emitted by the acceleration sensor. To distinguish spurious signals from these typical signals which should cause a switching on or off of the illumination, a low pass filter or preferably a band-pass filter is provided. The upper end frequency of the filter employed lies between 20 and 50 Hz, preferably at 25 Hz. The low end frequency of the band-pass filter, which is preferably used, is 6 Hz. It can, however, be in a frequency range of 3 to 15 Hz. The low pass filter or the band-pass filter can be set up as an active or passive RC filter. The filter is preferably connected in series before the said amplifier.

BRIEF DESCRIPTION OF THE DRAWINGS

A preferred embodiment of the diving measuring device according to the invention is described in the following, by way of example, with reference to the figures. Shown are.

DETAILED DESCRIPTION OF THE PREFERRED EMBODIMENTS

Figure 1:
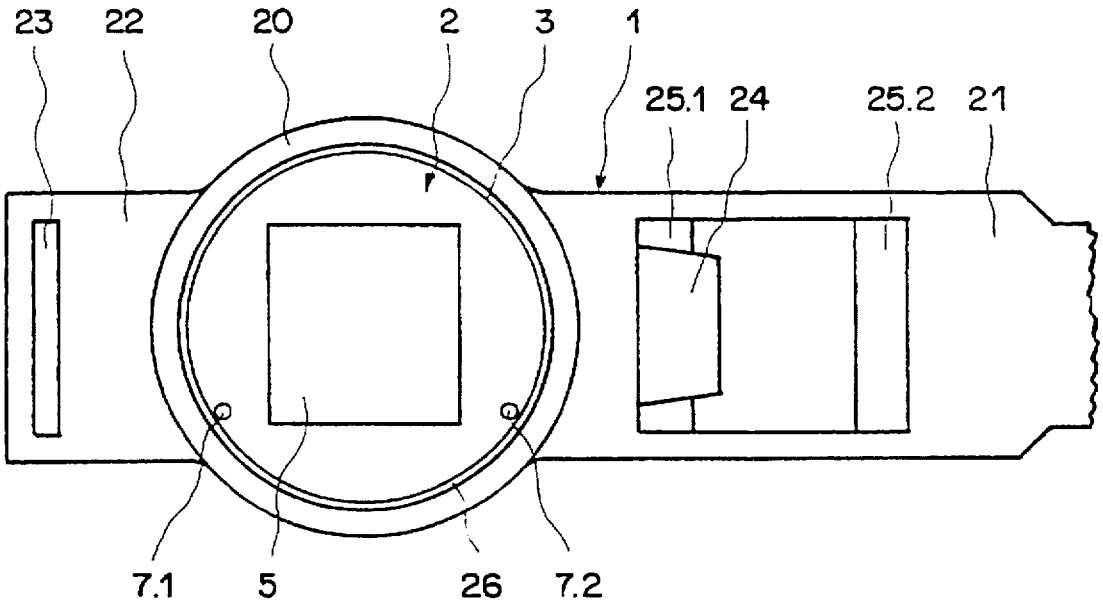
FIG. 1, a view from above of a diving computer according to the invention, which, of the wristwatch type, is disposed in a carrying device with a fastening band.

Shown in FIG. 1 is a view of a first embodiment of a diving measuring device according to the invention. It is a diving computer 2, which is held in a carrying device 20 made preferably of an elastic material, for example a material containing silicon. The diving computer 2 shown in the example, which is designed essentially cylindrical and tablet-shaped, is thus inserted into a hollow, cylindrical opening of the carrying device 20. Provided on the carrying device is a fastening band 21, which is intended for fastening the diving measuring device 1 to an arm or a leg of the diver. For this purpose it is slipped around the selected limb, led through a lead-through opening 23 of a attaching strap 22 of the carrying device, through further lead-through openings 25.1, 25.2 and brought into engagement with a closure flap 24. The fastening band 21 and the attaching 25 strap 22 are mounted on the carrying device 20 in a way similar to a wristband of a wristwatch, the carrying device corresponding essentially to a watchcase. So that the fastening strap 21 can engage with the closure flap 24, slit-type openings running crosswise to the strap at periodical intervals are provided on the part of the fastening band not shown.

The diving computer 2 is mounted in a cup-shaped housing 3, preferably made of transparent plastic. In the example embodiment shown an encircling housing rib 26 limits the insertion depth in the said hollow-cylindrical opening of the carrying device 20. A display device 5 is disposed on the inside immediately adjacent to the housing floor. This is preferably a liquid crystal display module 5, the display field of which is visible through the transparent housing floor. Provided in the housing floor are two small openings, through each of which a metal pin 7.1, 7.2 is led in such a way that the fore-part of the said metal pins, preferably of stainless steel, are flush with the outer surface of the housing floor. The metal pins serve to turn on the diving computer. In water they are electrically connected by means of the water conductance and in this way cause the switching on of the computer. The computer thus remains switched on during the entire dive.

Figure 2:
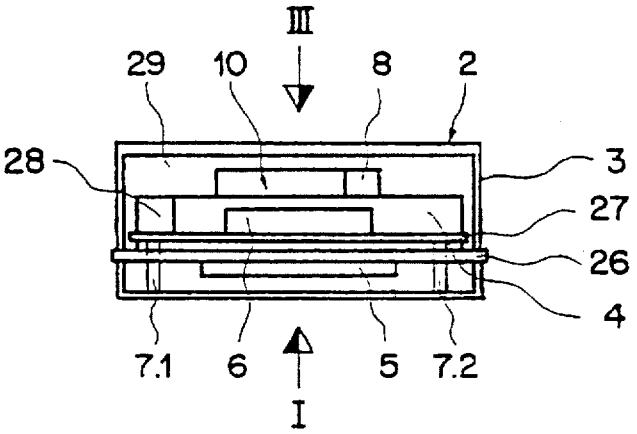
FIG. 2, a side view of the diving computer taken out of the carrying device of FIG. 1.

In the side view of the diving computer 2 according to FIG. 2, one can see the liquid crystal display module 5 and the contact pins 7.1, 7.2 through the transparent housing. These components are disposed essentially on the side of a printed circuit board turned toward the floor of the housing 3. On the opposite side of this printed circuit board 27 several electronic elements are provided shown as group 4. These comprise a microprocessor, storage means, resistors, capacitances, and a pressure sensor 28. The electronic components are fed by an electricity source, preferably a lithium battery 6. This energy source is connectible with the electronic components by means of switching-on means 7.1, 7.2. Designated 8 is the element according to the invention which reacts to changes in motion. As has already been said, this element is preferably an acceleration sensor. However, a microphone, for example an electret-microphone, could also be used. Indicated by 10 is an evaluation electronic circuit, which evaluates signals transmitted by the acceleration sensor during changes in motion and which thereby generates an output signal intended for switching on and off a background illumination which is integrated in the liquid crystal display module. The cup-shaped housing 3 is filled with a permanently elastic silicon material. All the components accommodated in the housing are therefore protected against water and moisture. Replacement of the battery 6, not necessary until after a period of about 5 years even when the diving computer is used very frequently, is carried out by opening the silicon sealing material at the corresponding place and by resealing after the battery has been changed. The pressure sensor 28 can sense the surrounding pressure outside the housing thanks to the permanently elastic silicon sealing material.

The acceleration sensor 8 can also be designed in such a way that it senses preferably changes of motion in one direction. The direction can be a direction approximately perpendicular to the faces of the tablet-shaped diving computer 2.

Figure 3:
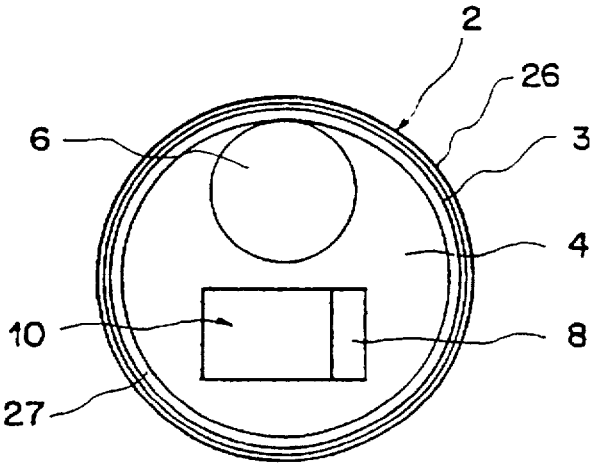
FIG. 3 a back view of the diving computer according to FIGS. 1 and 2.

Essentially visible, viewed from the back side according to FIG. 3, are the printed circuit board 27, the electronic components represented together as the group 4, the element 8 which reacts to changes in motion, the electronic circuit 10 associated thereto and the electricity source 6. The electronic circuit 10 and the element which senses changes in motion 8, parts only indicated symbolically here, are of course also disposed preferably on the printed circuit board 27. For relatively easy change of the battery, the space turned toward the printed circuit board above the energy source or battery, respectively, is freely accessible. The silicon sealing material can be easily removed from this place, the battery exchanged and the opening resulting therefrom sealed again with a silicon sealing material.

Figure 4:
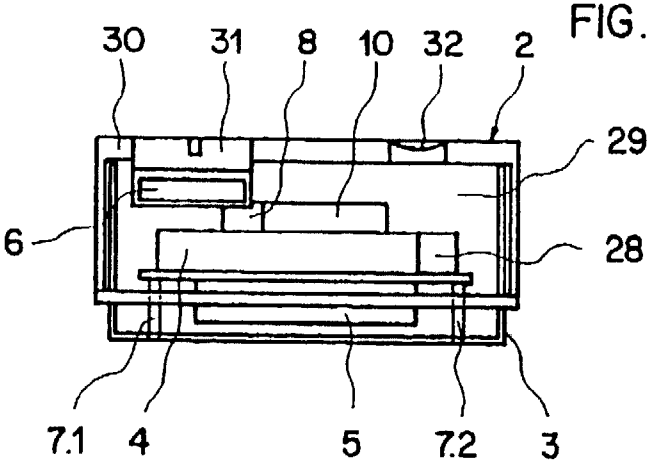
FIG. 4 a side view of a variant embodiment of the diving computer.

Of course it is also conceivable to cover the cup-shaped housing 3 with a cover 30. Such an embodiment is shown in FIG. 4. The cover 30 is preferably provided with a first opening through which a battery compartment is accessible, for placement of the electricity source 6. The battery compartment can be closed water-tightly with a battery compartment closing device 31. A further opening 32 is provided in the housing cover, which serves on the one hand as an opening for filling the silicon material. On the other hand it is intended to convey the pressure affecting the diving computer from outside to the pressure sensor 28.

Figure 5:
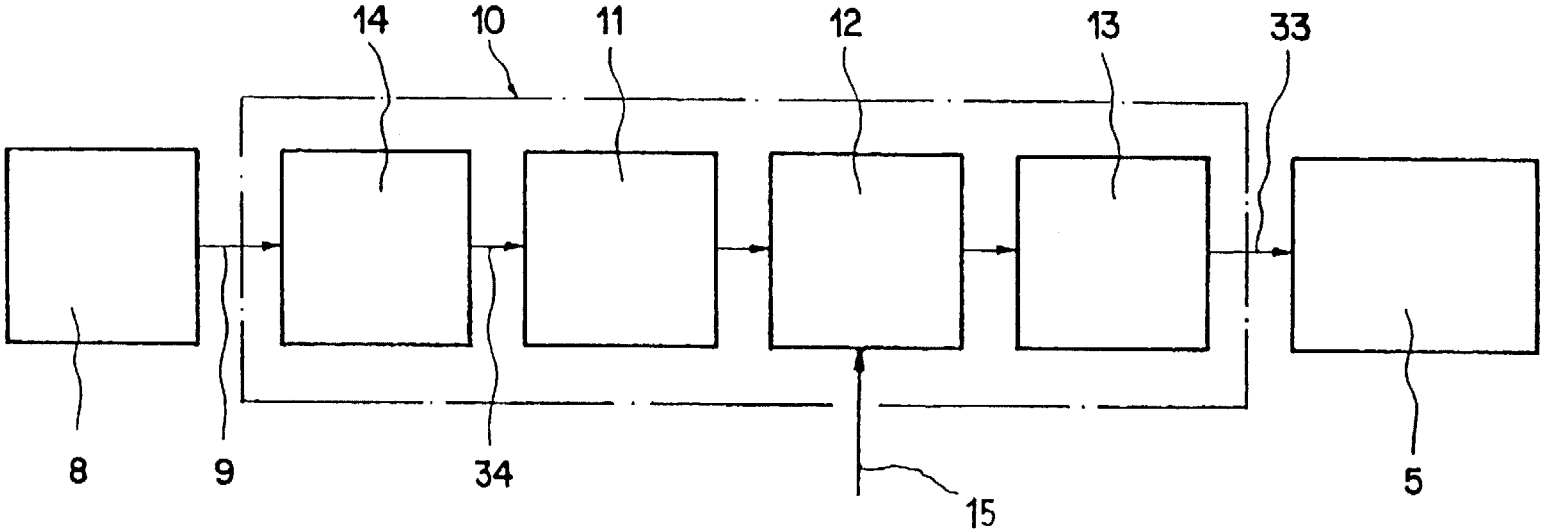
FIG. 5 a block diagram of an evaluation electronic circuit for the switching on and off of the illumination of diving data display device and FIG. 6 attenuation curves of the filters used in the electronic circuit.
Figure 6:
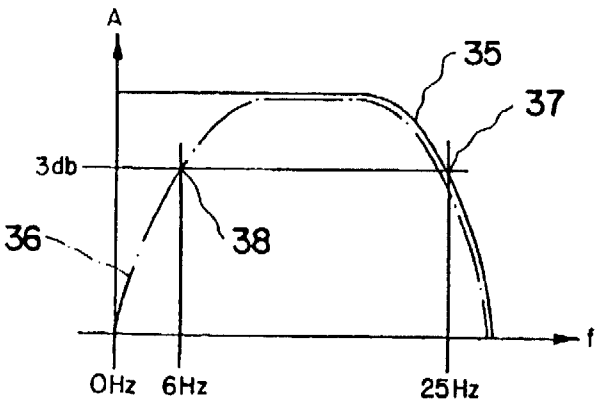

The electronic circuit for evaluating the signal 9 transmitted by the acceleration sensor 8 is shown in block diagram form in FIG. 5. The electrical signal 9 emitted by the acceleration sensor during a change of motion is led to a filter 14. This can be an active or passive RC filter, and can be designed as a low pass filter or preferably a bandpass filter. Via a filter output 34, the filtered signal reaches an amplifier desigated by 11. The signal is amplified there, and then led to a bistable switching circuit 12. This turns a driver circuit 13 either on or off. In the switched-on state, the driver circuit 13 supplies the electricity 33, which is needed for the background illumination of the LCD module 5. Each time when the bistable switching circuit 12 receives at its input a signal from the amplifier 11 of sufficient magnitude to surpass a certain predetermined threshold, the switching circuit switches from its state at the time into the other bistable state. It remains there until another input signal which surpasses the threshold is received. The illumination of the display device, in particular the background illumination of the LCD module 5, is always then switched off when no display of data is foreseen on the LCD module. This is always the case with a switched-off diving computer. A display-free state can also occur with a switched-on diving computer, however. The switching off of the illumination in the latter case can take place, for example, connection 15 to the electronic elements 4 which acts correspondingly on the bistable switching circuit 12. The filter 14 has the task of filtering the typical signals which the acceleration sensor emits when the diving computer 2 is struck or knocked on, and conveying them to the amplifier 11. The filter should prevent signals from only weak changes of motion or abrasion noises from likewise causing a switching on or off of the illumination. It has been determined that when striking or knocking upon the diving computer the acceleration sensor 8 emits distinct signals in a frequency range between 6 and 25 Hz. So that preferably only these signals are applied to the amplifier 11, connection of a band-pass filter in series to the amplifier is foreseen, with a passband response curve as shown in FIG. 6 under the designation 36. The band-pass filter has an upper end frequency 37 of preferably 25 Hz and a low end frequency of preferably 6 Hz. The limiting frequencies can, however, lie within the approximate frequency ranges mentioned earlier.

A low pass filter could also be provided instead of a band-pass filter. A corresponding response curve for such a filter is shown in FIG. 6 under the designation 35.

The described design of the switching on and off of the illumination of the display device of the diving computer according to the invention shows that the switching circuit can be carried out easily and securely, in particular under water, by merely knocking on the diving computer or striking the latter against any other object. It is thereby unimportant whether the diving computer, as shown in FIG. 1, is carried strapped around an arm or a leg or whether it is hung on a fastening band somewhere on the diving-suit or on an item of diving gear.

The entire device for switching on and off the illumination is cast water-tight in the sealing material. Particular problems, specifically sealing problems during manufacture of the diving computer, thus do not occur.

It is obvious that the inventive solution for switching on and off the illumination can also be used for switching on and off other diving measuring instruments or other parts of the diving computer. More than one liquid crystal display element could be built in, whereby the background illumination of only one or of more than one of these LCD modules could be switched on and off using the switching device according to the invention.

What is claimed is:

1. A diving measuring device comprising:

a housing;

electronic components which are disposed water-tightly in the housing;

at least one diving data display device which is disposed water-tightly in the housing;

an illumination, which can be switched on and off, associated with the diving data display device;

an electricity source, which is disposed water-tightly in the housing;

switching on means responsive to water immersion for connecting the energy source to the electronic components; and an element which reacts to changes of motion of the diving measuring device, which element is intended to switch on and off the illumination.

2. The diving measuring device of claim 1, wherein the element which reacts to changes of motion is an acceleration sensor.

3. The diving measuring device of claim 1, wherein the element which reacts to changes of motion is a microphone.

4. The diving measuring device of claim 1, wherein the element which reacts to changes of motion is mounted water-tightly in the housing.

5. The diving measuring device of claim 1, wherein the at least one diving data display device is a LCD module with a background illumination.

6. The diving measuring device of claim 1, further comprising an electronic circuit with an amplifier, a bistable switching circuit and a driver circuit which is intended for control of the lighting, whereby the element which reacts to changes in motion transmits an electrical signal dependent upon the magnitude of a change in motion, which signal can be conveyed to the said electronic circuit.

7. The diving measuring device of claim 6, further comprising a low pass filter the limiting frequency of which is 20–50 Hz and which is disposed in the said electronic circuit.

8. The diving measuring device of claim 7, wherein the limiting frequency of the low pass filter is about 25 Hz.

9. The diving measuring device of claim 7, wherein the low pass filter is an active RC filter.

10. The diving measuring device of claim 7, wherein the low pass filter is a passive RC filter.

11. The diving measuring device of claim 7, wherein the low pass filter is connected in series before the amplifier.

12. The diving measuring device of claim 7, wherein the diving measuring device is a diving computer.

13. The diving measuring device of claim 6, further comprising a band-pass filter having an upper end frequency of 20 to 50 Hz and a low end frequency of 3 to 15 Hz.

14. The diving measuring device of claim 13, wherein the upper end frequency of the band-pass filter is about 25 Hz and the low end frequency about 6 Hz.

15. The diving measuring device of claim 13, wherein the band-pass filter is an active RC filter.

16. The diving measuring device of claim 13, wherein the band-pass filter is a passive RC filter.

17. The diving measuring device of claim 13, wherein the band-pass filter is connected in series before the amplifier.

18. A diving measuring device comprising:

a housing;

electronic components which are disposed water-tightly in the housing;

at least one diving data display device which is disposed water-tightly in the housing;

an illumination, which can be switched on and off, associated with the diving data display device;

an electricity source, which is disposed water-tightly in the housing;

means responsive to water immersion to connect the energy source to the electronic components; and an element which reacts to changes of motion, which is mounted water-tightly in the housing, and which is intended to switch on and off the illumination.

* * * * *